US010258102B2

(12) United States Patent
Hsu

(10) Patent No.: US 10,258,102 B2
(45) Date of Patent: Apr. 16, 2019

(54) AIRBAG DEVICE WITH PRESSURE REGULATING FUNCTION

(71) Applicant: Welter's Co., Ltd., Dou Liu, Yun Lin Hsien (TW)

(72) Inventor: Walter W. Hsu, Dou Liu (TW)

(73) Assignee: Welter's Co., Ltd., Dou Liu (TW)

( * ) Notice: Subject to any disclaimer, the term of this patent is extended or adjusted under 35 U.S.C. 154(b) by 163 days.

(21) Appl. No.: 15/451,494

(22) Filed: Mar. 7, 2017

(65) Prior Publication Data

US 2018/0255865 A1 Sep. 13, 2018

(51) Int. Cl.
*A43B 3/26* (2006.01)
*A43B 23/02* (2006.01)
*A43B 7/08* (2006.01)

(52) U.S. Cl.
CPC ..... *A43B 3/26* (2013.01); *A43B 7/085* (2013.01); *A43B 23/029* (2013.01)

(58) Field of Classification Search
CPC ..... A43B 3/26; A43B 23/029; A43B 13/20; A43B 13/203; A43B 13/206
See application file for complete search history.

(56) References Cited

U.S. PATENT DOCUMENTS 3,410,004 A * 11/1968 Finn ..... A43B 5/0407 36/71
4,361,969 A * 12/1982 Vermonet ..... A43B 13/203 36/29
5,113,599 A * 5/1992 Cohen ..... A43B 17/035 36/114
5,158,767 A * 10/1992 Cohen ..... A43B 5/0407 36/114
5,392,534 A * 2/1995 Grim ..... A43B 7/147 36/154
5,617,650 A * 4/1997 Grim ..... A43B 7/147 36/154
6,189,172 B1 * 2/2001 Baek ..... A43B 5/0407 12/142 P
6,785,985 B2 * 9/2004 Marvin ..... A43B 13/20 36/29
2012/0167413 A1 * 7/2012 Marvin ..... A43B 13/20 36/83
2015/0305436 A1 * 10/2015 Doyle ..... A43B 13/203 36/43

* cited by examiner

*Primary Examiner* — Jila M Mohandesi
(74) *Attorney, Agent, or Firm* — Alan D. Kamrath; Kamrath IP Lawfirm, P.A.

(57) ABSTRACT

An airbag device includes a wear and an elastic module mounted on the wear. The wear has a wearing space. The elastic module is mounted in the wearing space of the wear and includes a first air bag, a second air bag, a first control valve and a second control valve. The first control valve is connected with the first air bag and is provided with a first oneway air inlet and a first oneway air outlet. The second control valve is connected between the first air bag and the second air bag and is provided with a second oneway air inlet and a second oneway air outlet. The second control valve and the first control valve are operated synchronously.

6 Claims, 12 Drawing Sheets

AIRBAG DEVICE WITH PRESSURE REGULATING FUNCTION

BACKGROUND OF THE INVENTION

1. Field of the Invention

The present invention relates to a bag device and, more particularly, to an airbag device for a wear, such as a hat, a pair of shoes, a protective gear or the like.

2. Description of the Related Art

Conventional shoes have a determined size and specification so that the shoes cannot exactly satisfy the requirement of users of different foot sizes. In addition, when the size of the shoes is too large, the user has to place cushions or pads into the shoes to compensate the clearance between the shoes and the user's feet, thereby easily causing uncomfortable sensation to the user. Further, it is often necessary to provide shoelaces to tighten the shoes, thereby causing inconvenience to the user when needing to tie the shoelaces.

BRIEF SUMMARY OF THE INVENTION

The primary objective of the present invention is to provide an airbag device with a pressure regulating function.

In accordance with the present invention, there is provided an airbag device comprising a wear and an elastic module mounted on the wear. The wear has a wearing space. The elastic module is mounted in the wearing space of the wear and includes a first air bag, a second air bag, a first control valve, and a second control valve. The first control valve is connected with the first air bag and is provided with a first oneway air inlet and a first oneway air outlet. The second control valve is connected between the first air bag and the second air bag and is provided with a second oneway air inlet and a second oneway air outlet. The second control valve and the first control valve are operated synchronously.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
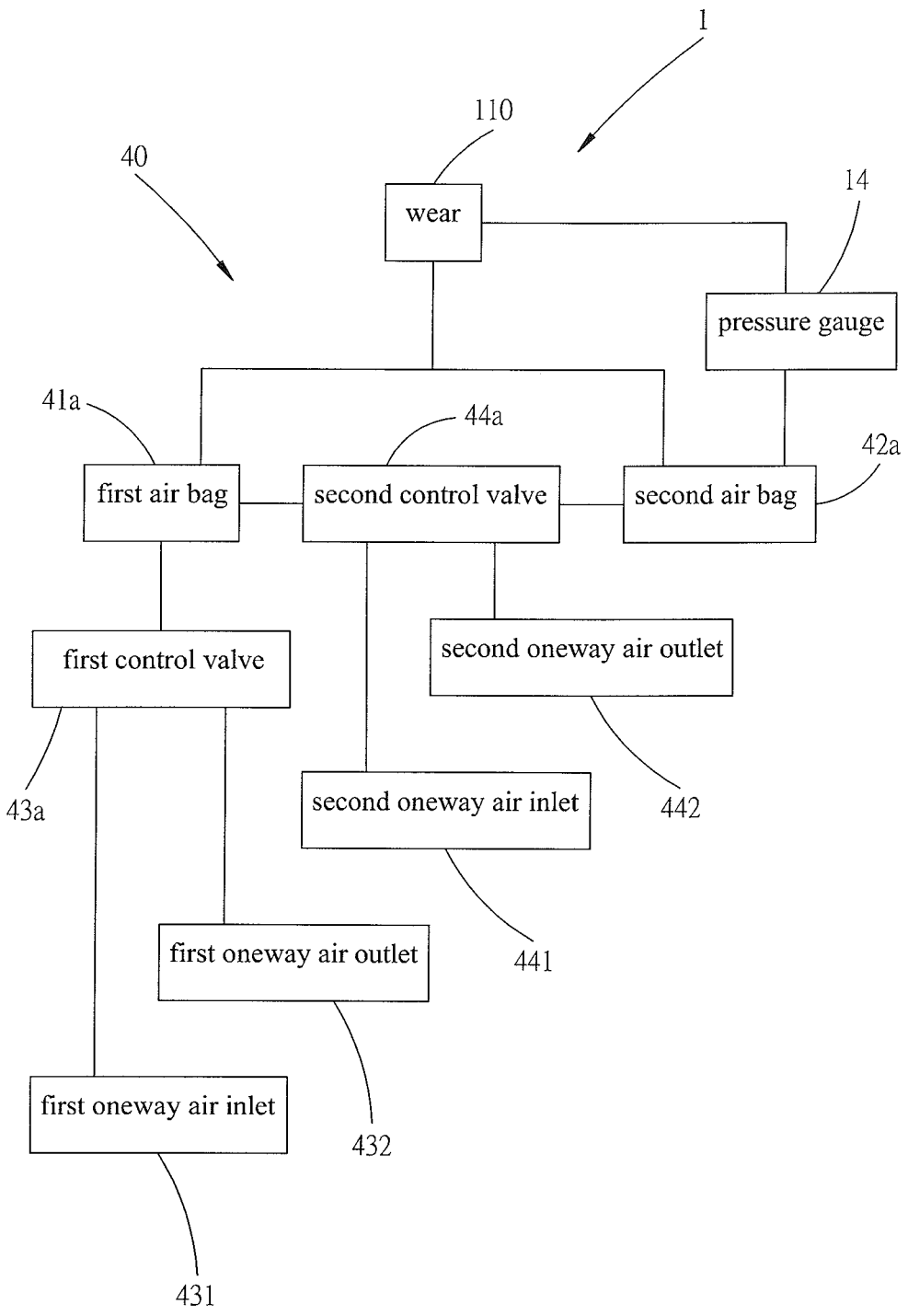
FIG. 1 is a block diagram of an airbag device in accordance with the preferred embodiment of the present invention.
Figure 2:
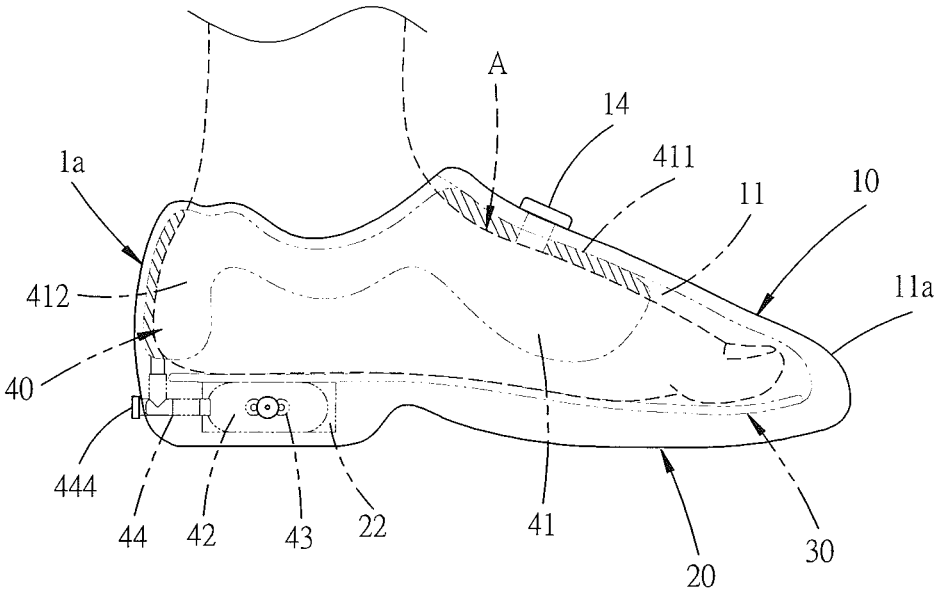
FIG. 2 is a side view of a shoe structure in accordance with the preferred embodiment of the present invention.
Figure 3:
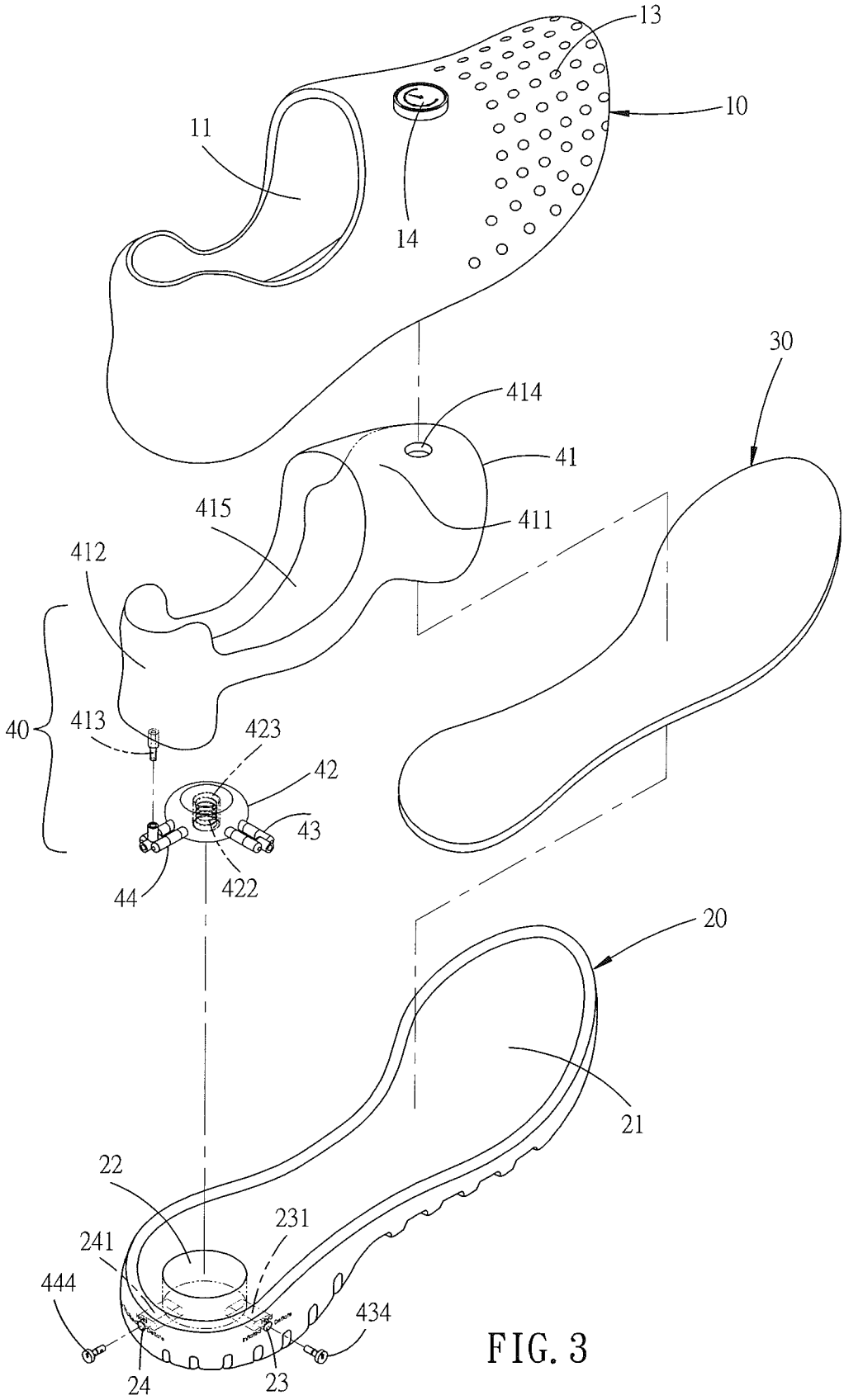
FIG. 3 is a partially exploded perspective view of the shoe structure in accordance with the preferred embodiment of the present invention.
Figure 4:
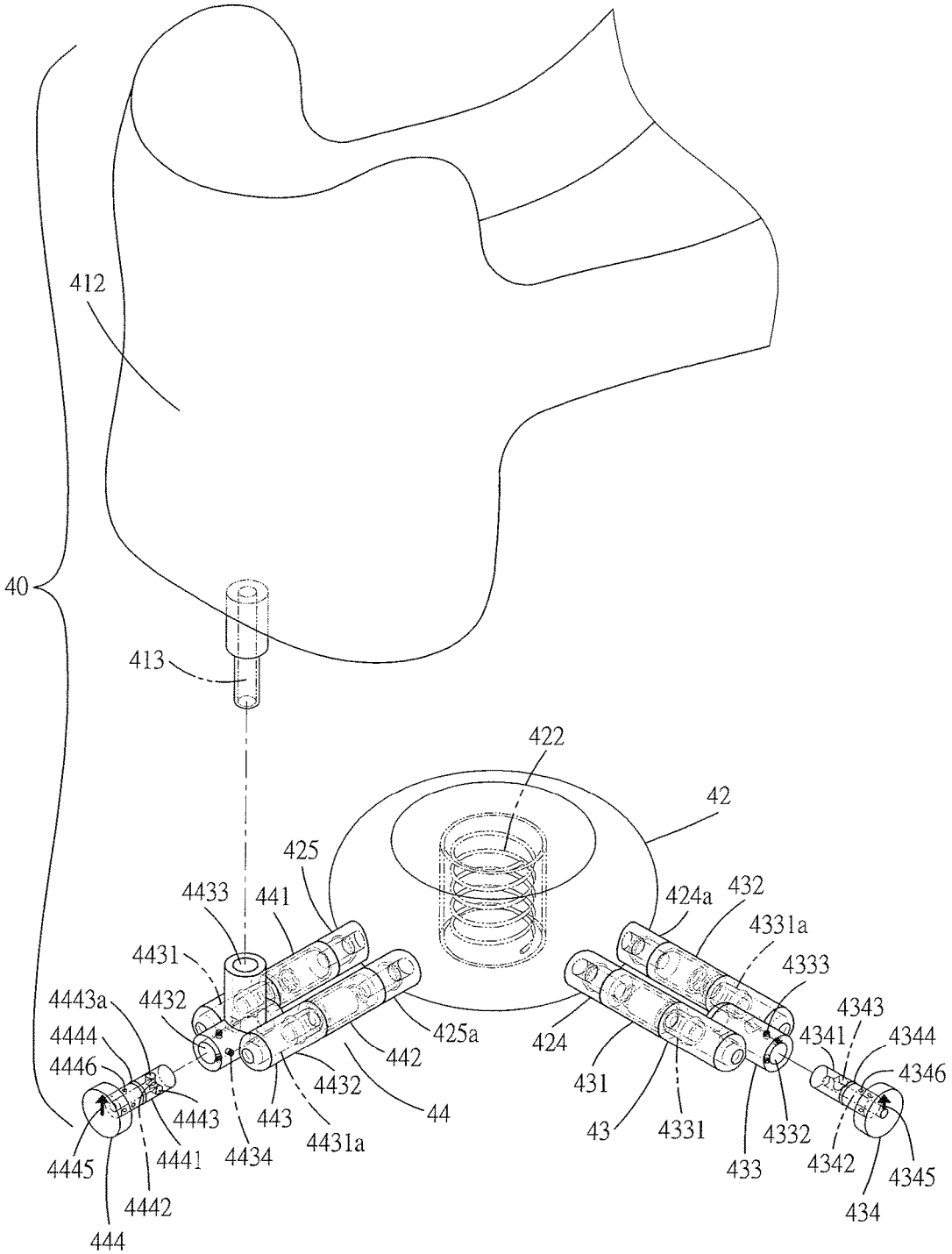
FIG. 4 is a locally enlarged exploded perspective view of the shoe structure in accordance with the preferred embodiment of the present invention.
Figure 5:
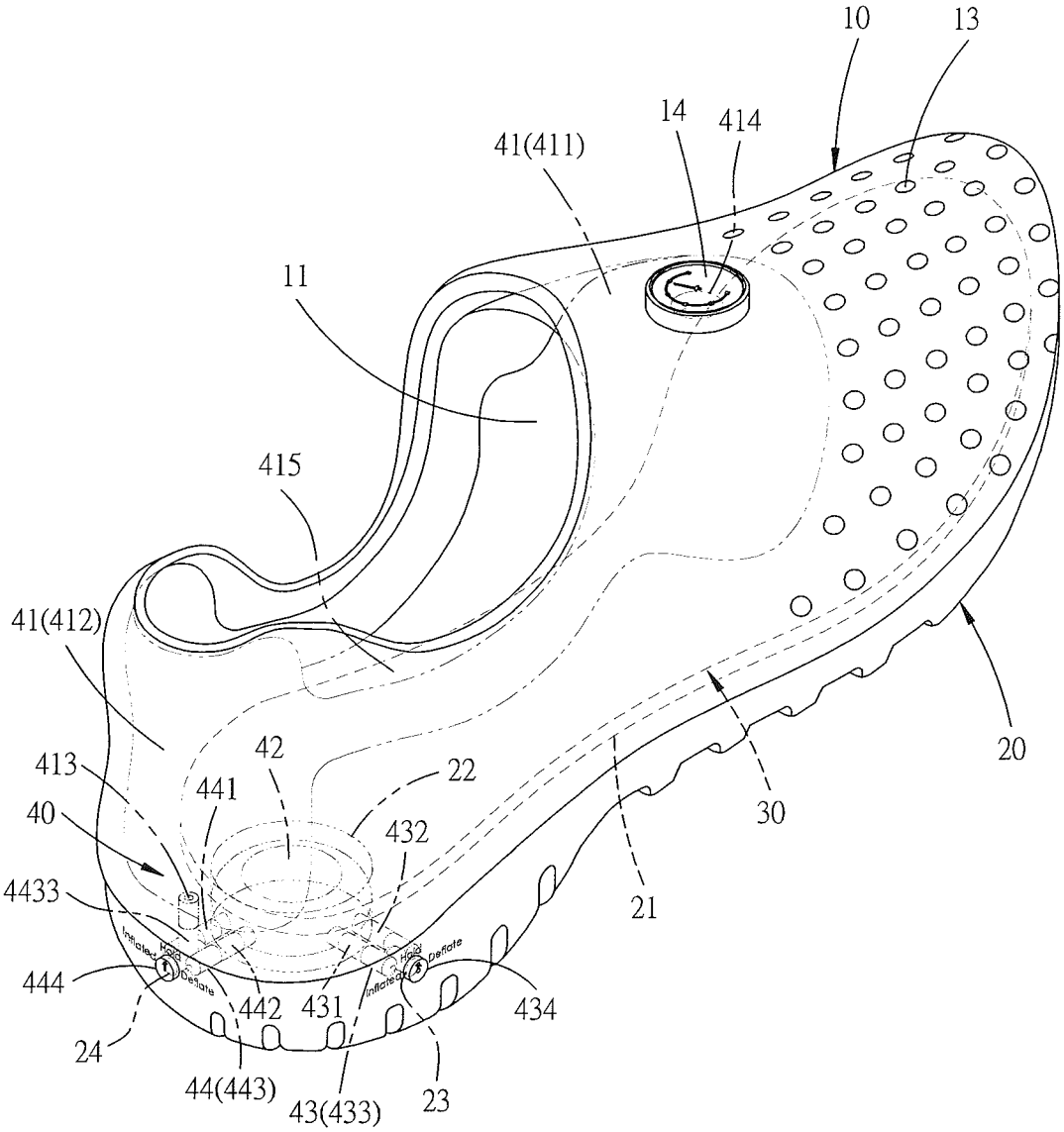
FIG. 5 is a perspective view of the shoe structure in accordance with the preferred embodiment of the present invention.
Figure 6:
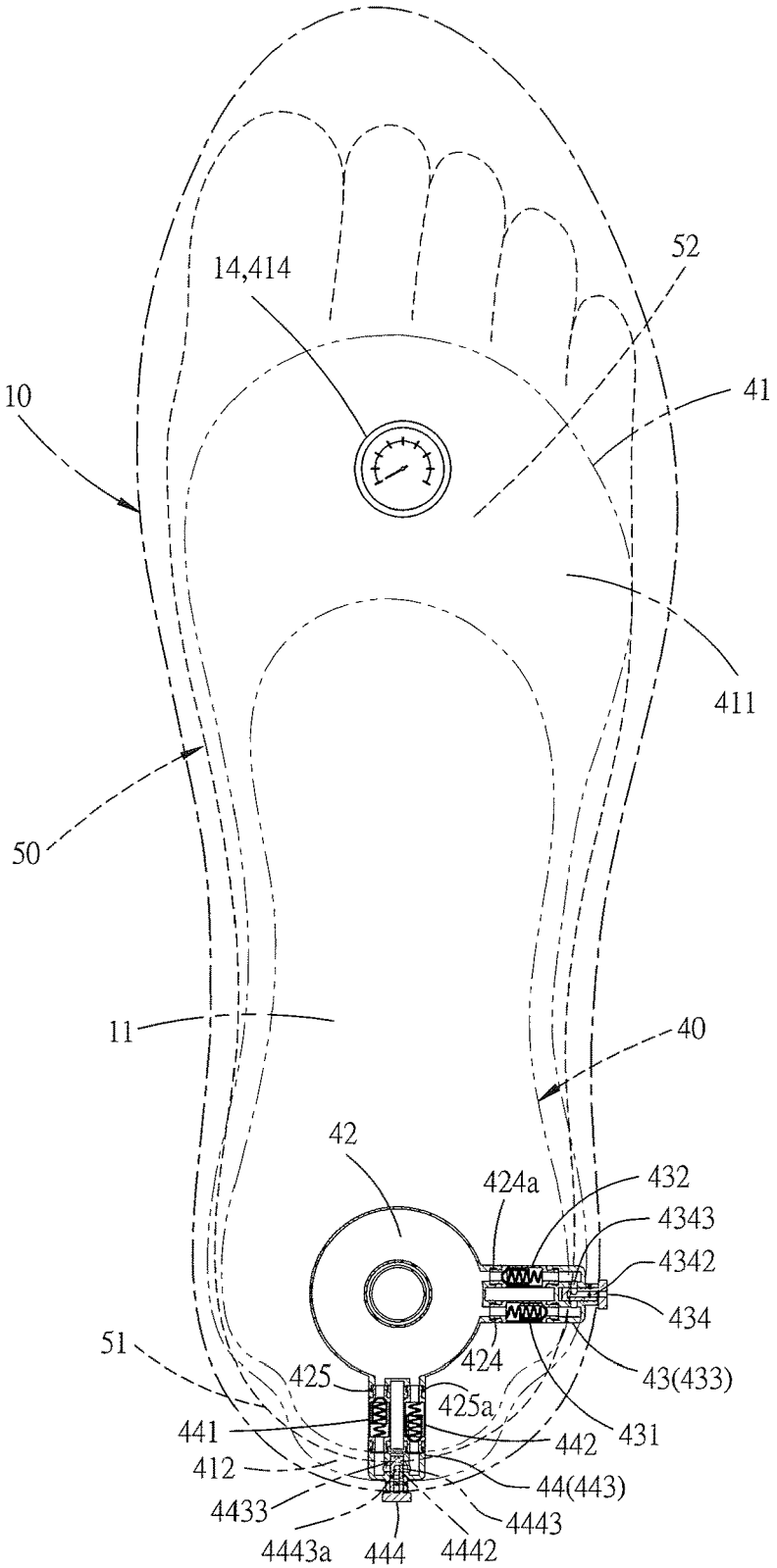
FIG. 6 is a top cross-sectional view of the shoe structure in accordance with the preferred embodiment of the present invention.

Referring to the drawings and initially to FIG. 1, an airbag device in accordance with the preferred embodiment of the present invention comprises a wear 110 and an elastic module 40 mounted on the wear 110. The wear 110 is preferably a hat, a pair of shoes, a protective gear or the like. The wear 110 has a wearing space 11 (see FIG. 3). The elastic module 40 is mounted in the wearing space 11 of the wear 110 and includes a first air bag 41*a*, a second air bag 42*a*, a first control valve 43*a*, and a second control valve 44*a*. The first control valve 43*a* is connected with the first air bag 41*a* and forms a oneway air inlet circuit or a oneway air outlet circuit. The first control valve 43*a* is provided with a first oneway air inlet 431 and a first oneway air outlet 432. The second control valve 44*a* is connected between the first air bag 41*a* and the second air bag 42*a* and forms a oneway air inlet circuit or a oneway air outlet circuit. The second control valve 44*a* is provided with a second oneway air inlet 441 and a second oneway air outlet 442. The second control valve 44*a* and the first control valve 43*a* are operated synchronously. A pressure gauge 14 is connected between the wear 110 and the second air bag 42*a*. Thus, the first air bag 41*a* and the second air bag 42*a* provide a high elastic support function.

Referring to FIGS. 2-6, a shoe structure 1*a* in accordance with the preferred embodiment of the present invention comprises a shoe body 11*a* and an elastic module 40 mounted on the shoe body 11*a*.

The shoe body 11*a* includes a vamp 10, a sole 20 and an insole 30. The vamp 10 has an interior provided with a wearing space 11 and has a surface provided with a plurality of vent holes 13. The sole 20 is provided with a receiving dimple 21 and a chamber 22. The insole 30 is mounted in the receiving dimple 21 of the sole 20. The chamber 22 of the sole 20 corresponds to a foot heel 51 (see FIG. 6). The sole 20 has a periphery provided with a first valve hole 23 connected to the chamber 22 and a second valve hole 24 connected to the chamber 22. The first valve hole 23 has a first channel 231. The second valve hole 24 has a second channel 241. Each of the first valve hole 23 and the second valve hole 24 of the sole 20 has a periphery provided with multiple indication characters, including "inflated", "Deflate" and "Hold".

The elastic module 40 is mounted in the wearing space 11 of the vamp 10 and includes a first air bag 41, a second air bag 42, a first control valve 43 and a second control valve 44. The first air bag 41 is an endless hollow airbag and is combined with an inner periphery of the vamp 10. The second air bag 42 is mounted in the chamber 22 of the sole 20. The first control valve 43 is connected with the second air bag 42. The first control valve 43 includes a first oneway air inlet 431, a first oneway air outlet 432, a first oneway valve seat 433 and a first regulating lever 434. The first regulating lever 434 is pivotally mounted in the first valve hole 23 of the sole 20 and is connected with the first oneway valve seat 433 to control air inlet and outlet operation of the first control valve 43. The second control valve 44 is connected between the first air bag 41 and the second air bag 42. The second control valve 44 includes a second oneway air inlet 441, a second oneway air outlet 442, a second oneway valve seat 443 and a second regulating lever 444. The second regulating lever 444 is pivotally mounted in the second valve hole 24 of the sole 20 and is connected with the second oneway valve seat 443 to control air inlet and outlet operation of the second control valve 44.

In the preferred embodiment of the present invention, the first air bag 41 of the elastic module 40 is provided with an instep cushion portion 411 and a heel cushion portion 412 respectively resting on a periphery of the wearing space 11. The first air bag 41 of the elastic module 40 has a rear end provided with an air nozzle 413 connected to the second control valve 44. A pressure gauge 14 is mounted on the vamp 10, and the first air bag 41 of the elastic module 40 has a front end provided with an air hole 414 connected to the pressure gauge 14.

In the preferred embodiment of the present invention, the second air bag 42 has a center provided with a compression elastomer 422. The second air bag 42 has a periphery provided with a first inlet pipe 424 connected with the first oneway air inlet 431 of the first control valve 43, a first outlet pipe 424*a* connected with the first oneway air outlet 432 of the first control valve 43, a second inlet pipe 425 connected with the second oneway air inlet 441 of the second control valve 44, and a second outlet pipe 425*a* connected with the second oneway air outlet 442 of the second control valve 44.

In the preferred embodiment of the present invention, the first oneway valve seat 433 of the first control valve 43 is a three-way element and includes two first connecting pipes 4331 and 4331*a* respectively connected with the first oneway air inlet 431 and the first oneway air outlet 432, and a first mounting tube 4332 connected between the two first connecting pipes 4331 and 4331*a*. The first mounting tube 4332 is mounted in the first valve hole 23 of the sole 20. The second oneway valve seat 443 of the second control valve 44 is a three-way element and includes two second connecting pipes 4431 and 4431*a* respectively connected with the second oneway air inlet 441 and the second oneway air outlet 442, a second mounting tube 4432 connected between the two second connecting pipes 4431 and 4431*a*, and an air pipe 4433 connected between the second mounting tube 4432 and the air nozzle 413 of the first air bag 41. The second mounting tube 4432 is mounted in the second valve hole 24 of the sole 20.

The first regulating lever 434 of the first control valve 43 is provided with a first connecting end 4341 pivotally mounted in the first mounting tube 4332 of the first oneway valve seat 433. The first connecting end 4341 of the first regulating lever 434 has a center provided with a first connecting channel 4342 connected to the ambient environment. The first connecting end 4341 of the first regulating lever 434 has a periphery provided with a first connecting hole 4343 connected to the first connecting channel 4342. In practice, the first regulating lever 434 of the first control valve 43 is rotatable relative to the first oneway valve seat 433 between a first position where the first connecting hole 4343 of the first regulating lever 434 is connected to one of the two first connecting pipes 4331 and 4331*a* of the first oneway valve seat 433 and a second position where the first connecting hole 4343 of the first regulating lever 434 is connected to the other one of the two first connecting pipes 4331 and 4331*a* of the first oneway valve seat 433. The first regulating lever 434 of the first control valve 43 is provided with a first control switch 4345 with an indication symbol, such as an arrow, corresponding to the indication characters of the first valve hole 23.

The second regulating lever 444 of the second control valve 44 is provided with a second connecting end 4441 pivotally mounted in the second mounting tube 4432 of the second oneway valve seat 443. The second connecting end 4441 of the second regulating lever 444 has a center provided with a second connecting channel 4442 disconnected from the ambient environment. The second connecting end 4441 of the second regulating lever 444 has a periphery provided with two second connecting holes 4443 and 4443*a* connected to the second connecting channel 4442. In practice, the second regulating lever 444 of the first control valve 43 is rotatable relative to the second oneway valve seat 443 between a first position where the two second connecting holes 4443 and 4443*a* of the second regulating lever 444 are respectively connected to the air pipe 4433 and one of the two second connecting pipes 4431 and 4431*a* of the second oneway valve seat 443 and a second position where the two second connecting holes 4443 and 4443*a* of the second regulating lever 444 are respectively connected to the air pipe 4433 and the other one of the two second connecting pipes 4431 and 4431*a* of the second oneway valve seat 443. The second regulating lever 444 of the second control valve 44 is provided with a second control switch 4445 with an indication symbol, such as an arrow, corresponding to the indication characters of the second valve hole 24.

In the preferred embodiment of the present invention, the first connecting end 4341 of the first regulating lever 434 has an outer wall provided with a first O-ring 4344 sealed in the first mounting tube 4332 of the first oneway valve seat 433, and the second connecting end 4441 of the second regulating lever 444 has an outer wall provided with a second O-ring 4444 sealed in the second mounting tube 4432 of the second oneway valve seat 443. The first mounting tube 4332 of the first oneway valve seat 433 has an inner wall provided with a plurality of first positioning points 4333, and the first connecting end 4341 of the first regulating lever 434 is provided with a first positioning hole 4346 locked onto one of the first positioning points 4333 of the first mounting tube 4332. The second mounting tube 4432 of the second oneway valve seat 443 has an inner wall provided with a plurality of second positioning points 4434, and the second connecting end 4441 of the second regulating lever 444 is provided with a second positioning hole 4446 locked onto one of the second positioning points 4434 of the second mounting tube 4432.

Figure 7:
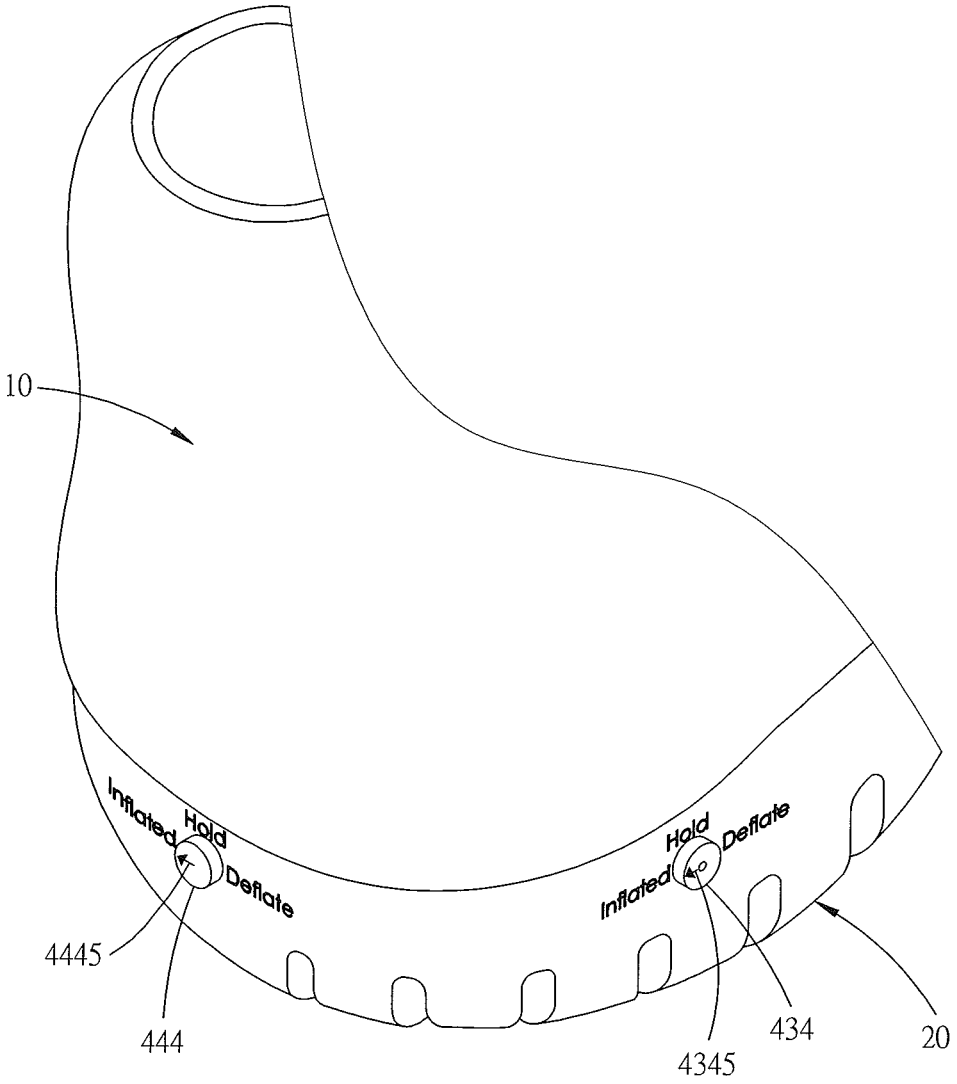
FIG. 7 is a perspective view showing the inflated state of the shoe structure in accordance with the preferred embodiment of the present invention.
Figure 8:
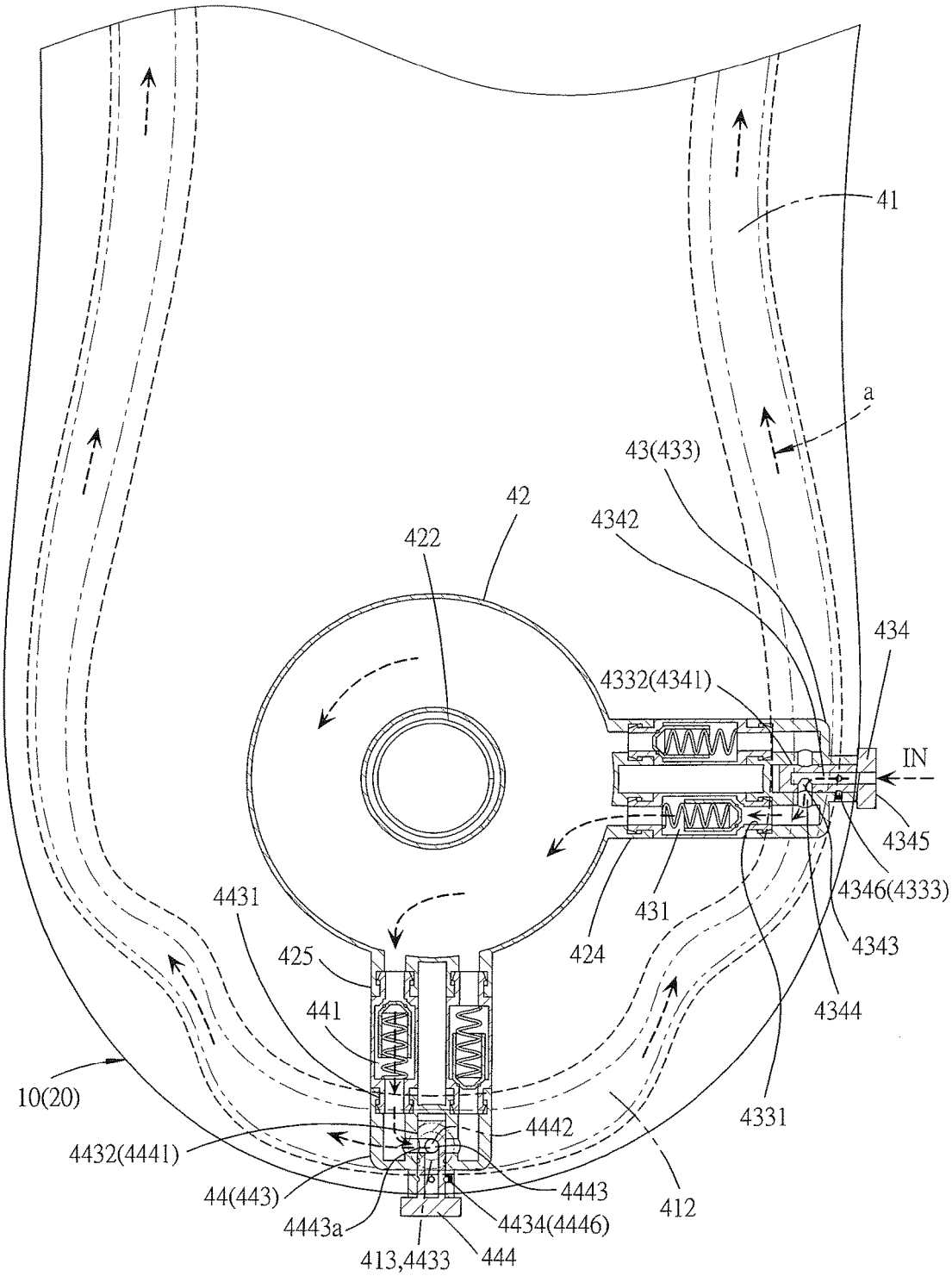
FIG. 8 is a top cross-sectional view showing the inflated state of the shoe structure in accordance with the preferred embodiment of the present invention.

In operation, referring to FIGS. 7 and 8 with reference to FIGS. 2-6, when the user wishes to perform the inflation procedure, the first control switch 4345 of the first regulating lever 434 and the second control switch 4445 of the second regulating lever 444 are rotated to align with the "inflated" indication character of the sole 20 as shown in FIG. 7. At this time, the first connecting hole 4343 of the first regulating lever 434 is connected to one of the two first connecting pipes 4331 and 4331*a* of the first oneway valve seat 433, so that the first connecting channel 4342 of the first regulating lever 434 is connected to the first oneway air inlet 431, while the two second connecting holes 4443 and 4443*a* of the second regulating lever 444 are respectively connected to the air pipe 4433 and one of the two second connecting pipes 4431 and 4431*a* of the second oneway valve seat 443, so that the second connecting channel 4442 of the second regulating lever 444 is connected between the second oneway air inlet 441 and the air pipe 4433 so as to connect the second oneway air inlet 441 with the air pipe 4433. In such a manner, the first air bag 41, the second air bag 42, the first oneway air inlet 431 of the first control valve 43 and the second oneway air inlet 441 of the second control valve 44 are interconnected to form a oneway air inlet space "a", so that a oneway air inlet flow channel in turn passes through the first connecting channel 4342 of the first regulating lever 434, one of the two first connecting pipes 4331 and 4331*a*, the first oneway air inlet 431, the first inlet pipe 424, the second air bag 42, the second inlet pipe 425, the second oneway air inlet 441 of the second control valve 44, one of the two second connecting pipes 4431 and 4431*a* of the second oneway valve seat 443, the second connecting channel 4442 of the second regulating lever 444, the air pipe 4433, the air nozzle 413 and the first air bag 41. Thus, when the second air bag 42 is stepped by the foot heel 51, the second air bag 42 is contracted to compress the compression elastomer 422, and the air in the second air bag 42 in turn passes through the second inlet pipe 425, the second oneway air inlet 441 of the second control valve 44, one of the two second connecting pipes 4431 and 4431*a* of the second oneway valve seat 443, the second connecting channel 4442 of the second regulating lever 444, the air pipe 4433 and the air nozzle 413 into the first air bag 41 so as to inflate the first air bag 41. On the contrary, when the second air bag 42 is released from the foot heel 51, the second air bag 42 is expanded by the restoring force of the compression elastomer 422 to produce a suction force, and the air from the ambient environment is drawn inward and in turn passes through the first connecting channel 4342 of the first regulating lever 434, one of the two first connecting pipes 4331 and 4331*a*, the first oneway air inlet 431 and the first inlet pipe 424 into the second air bag 42 as shown in FIG. 8. In such a manner, the second air bag 42 is contracted and expanded reciprocally by actions of the foot heel 51, so that the first air bag 41 is inflated successively and is stretched in the wearing space 11 of the vamp 10 to encompass a foot 50.

Figure 9:
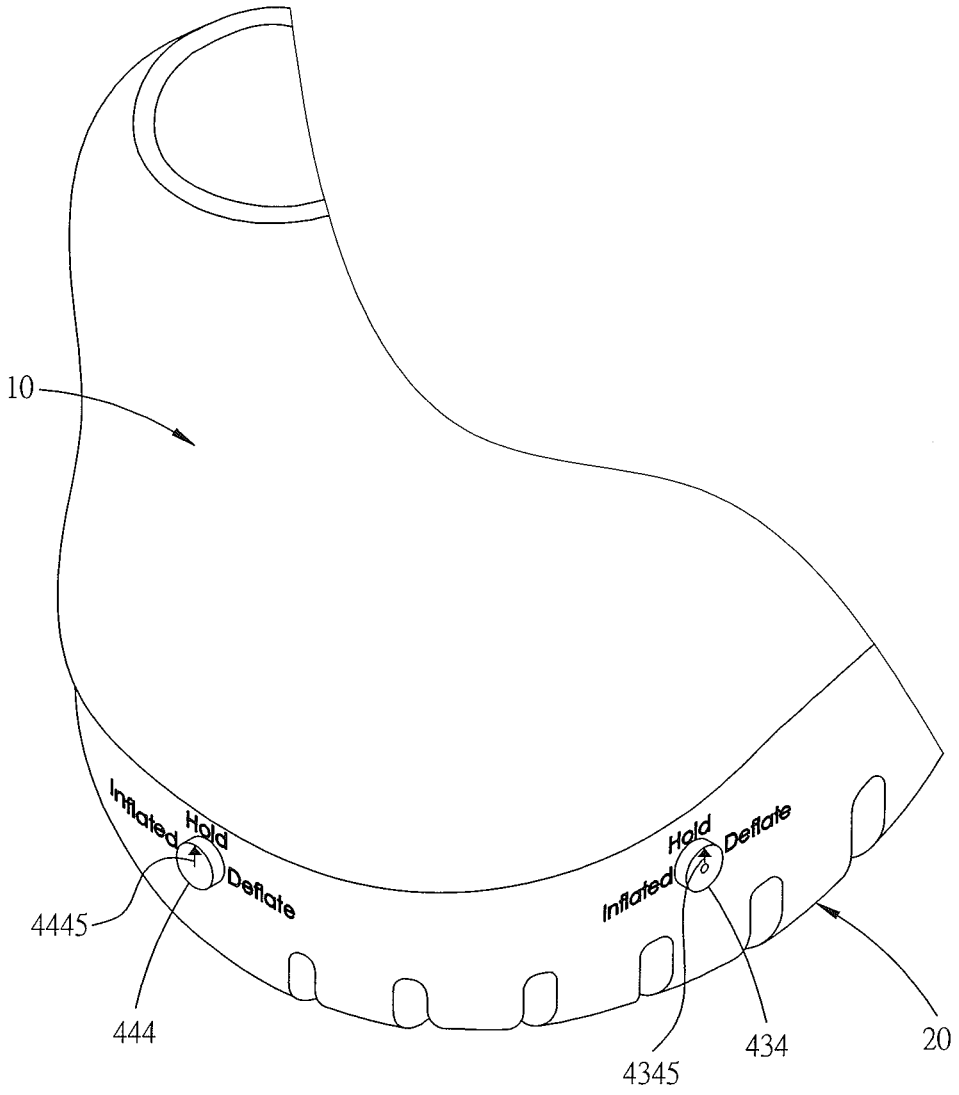
FIG. 9 is a perspective view showing the closed state of the shoe structure in accordance with the preferred embodiment of the present invention.
Figure 10:
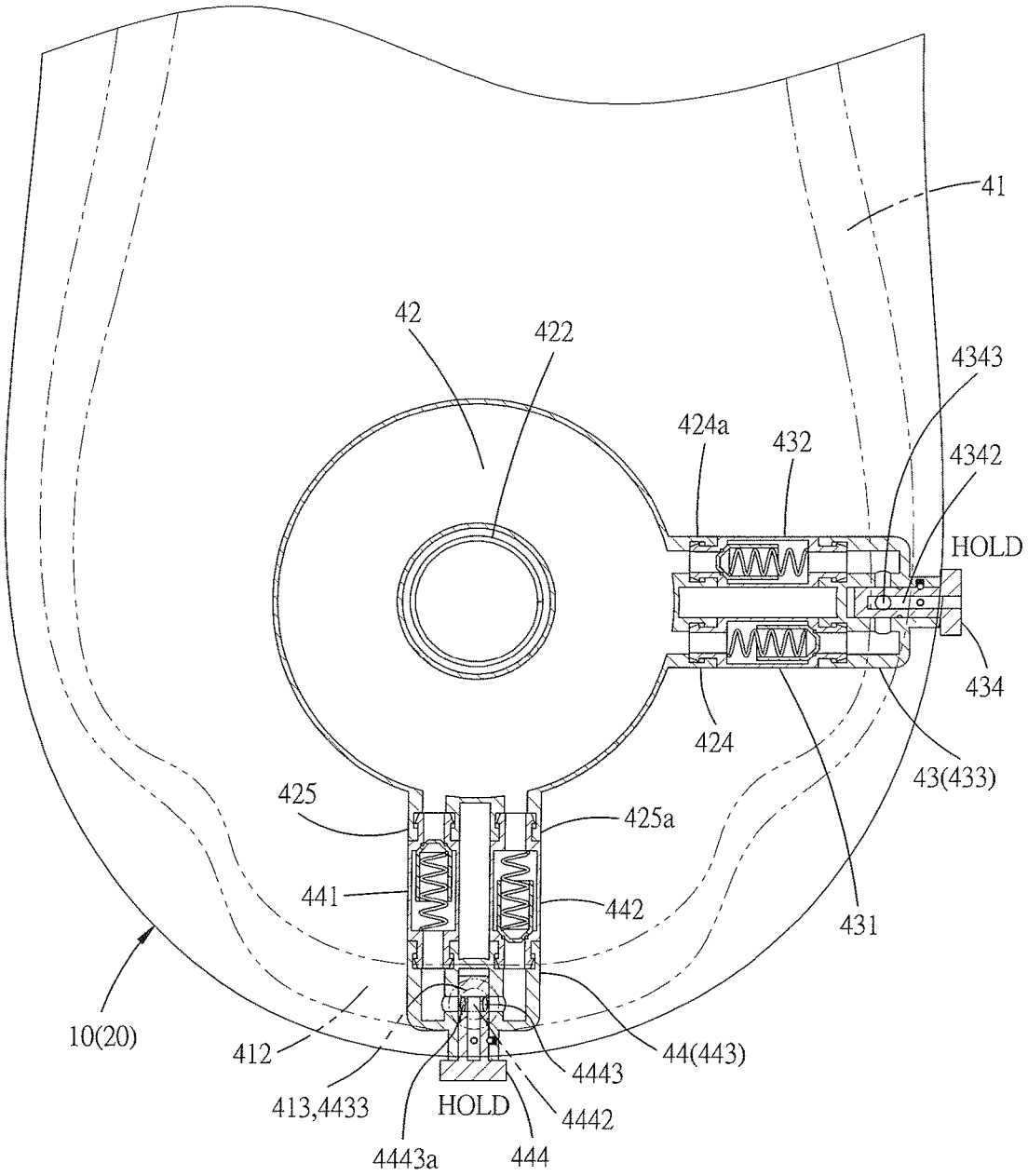
FIG. 10 is a top cross-sectional view showing the closed state of the shoe structure in accordance with the preferred embodiment of the present invention.

Referring to FIGS. 9 and 10 with reference to FIGS. 2-6, when the first control switch 4345 of the first regulating lever 434 and the second control switch 4445 of the second regulating lever 444 are rotated to align with the "Hold" indication character of the sole 20 as shown in FIG. 9, the first connecting hole 4343 of the first regulating lever 434 is isolated and sealed by the wall of the first mounting tube 4332 of the first oneway valve seat 433 to close the first oneway air inlet 431 of the first control valve 43, and the two second connecting holes 4443 and 4443*a* of the second regulating lever 444 are isolated and sealed by the wall of the second mounting tube 4432 of the second oneway valve seat 443 to close the second oneway air inlet 441 of the second control valve 44.

Figure 11:
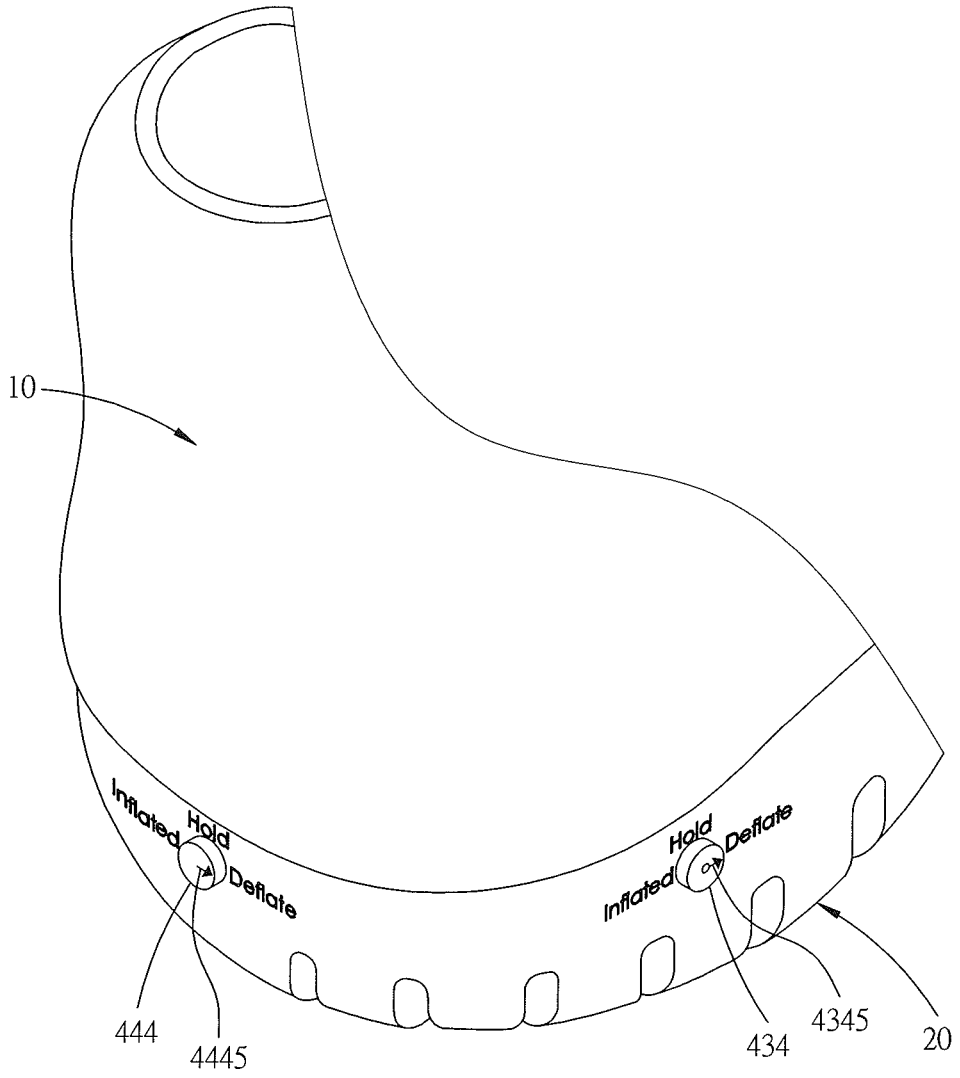
FIG. 11 is a perspective view showing the deflated state of the shoe structure in accordance with the preferred embodiment of the present invention.
Figure 12:
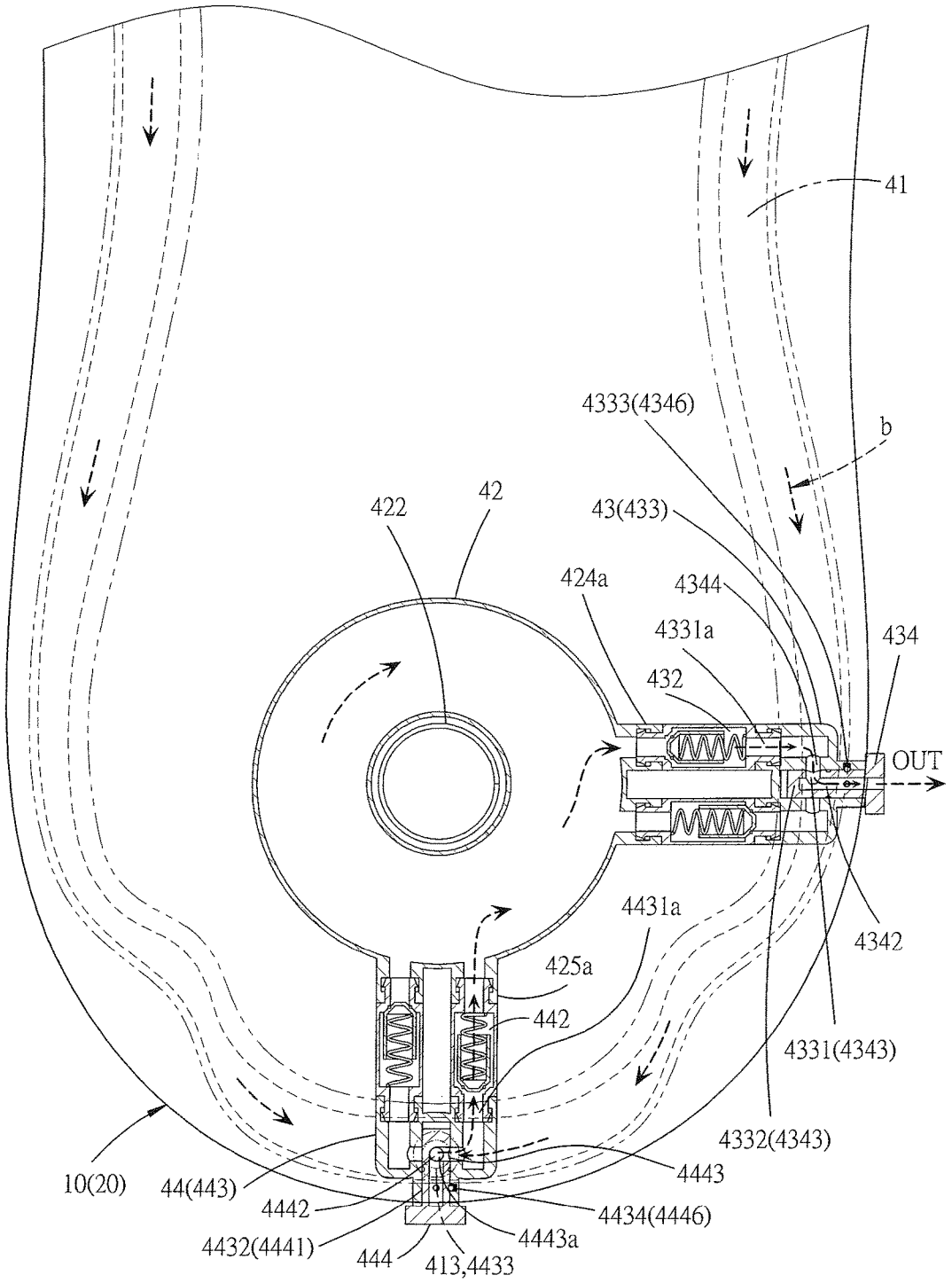
FIG. 12 is a top cross-sectional view showing the deflated state of the shoe structure in accordance with the preferred embodiment of the present invention.

Referring to FIGS. 11 and 12 with reference to FIGS. 2-6, when the user wishes to perform the deflation procedure, the first control switch 4345 of the first regulating lever 434 and the second control switch 4445 of the second regulating lever 444 are rotated to align with the "Deflate" indication character of the sole 20 as shown in FIG. 11. At this time, the first connecting hole 4343 of the first regulating lever 434 is connected to the other one of the two first connecting pipes 4331 and 4331*a* of the first oneway valve seat 433, so that the first connecting channel 4342 of the first regulating lever 434 is connected to the first oneway air outlet 432, while the two second connecting holes 4443 and 4443*a* of the second regulating lever 444 are respectively connected to the air pipe 4433 and the other one of the two second connecting pipes 4431 and 4431*a* of the second oneway valve seat 443, so that the second connecting channel 4442 of the second regulating lever 444 is connected between the second oneway air outlet 442 and the air pipe 4433 so as to connect the second oneway air outlet 442 with the air pipe 4433. In such a manner, the first air bag 41, the second air bag 42, the first oneway air outlet 432 of the first control valve 43 and the second oneway air outlet 442 of the second control valve 44 are interconnected to form a oneway air outlet space "b", so that a oneway air outlet flow channel in turn passes through the first air bag 41, the air nozzle 413, the air pipe 4433, the second connecting channel 4442 of the second regulating lever 444, the other one of the two second connecting pipes 4431 and 4431*a* of the second oneway valve seat 443, the second oneway air outlet 442 of the second control valve 44, the second outlet pipe 425*a*, the second air bag 42, the first outlet pipe 424*a*, the first oneway air outlet 432, the other one of the two first connecting pipes 4331 and 4331*a*, and the first connecting channel 4342 of the first regulating lever 434. Thus, when the second air bag 42 is stepped by the foot heel 51, the second air bag 42 is contracted to compress the compression elastomer 422, and the air in the second air bag 42 in turn passes through the first outlet pipe 424*a*, the first oneway air outlet 432, the other one of the two first connecting pipes 4331 and 4331*a*, and the first connecting channel 4342 of the first regulating lever 434, and is drained outward from the first connecting channel 4342 of the first regulating lever 434 as shown in FIG. 12. On the contrary, when the second air bag 42 is released from the foot heel 51, the second air bag 42 is expanded by the restoring force of the compression elastomer 422 to produce a suction force, and the air in the first air bag 41 is drawn outward and in turn passes through the air nozzle 413, the air pipe 4433, the second connecting channel 4442 of the second regulating lever 444, the other one of the two second connecting pipes 4431 and 4431*a* of the second oneway valve seat 443, the second oneway air outlet 442 of the second control valve 44 and the second outlet pipe 425*a* into the second air bag 42 as shown in FIG. 12. In such a manner, the second air bag 42 is contracted and expanded reciprocally by actions of the foot heel 51, so that the first air bag 41 is deflated successively.

Accordingly, the first air bag 41 and the second air bag 42 construct a double airbag structure with a pressure regulating function to cover the user's foot elastically so as to provide a great buffering effect to the user's foot and provide a comfortable sensation to the user. In addition, the first air bag 41 supports the user's foot elastically to release the pressure of the user's foot. Further, the first air bag 41 is inflated or deflated to support the user's foot ergonomically, without having to provide a shoelace, thereby facilitating the user wearing the shoes. Further, the first air bag 41 is inflated or deflated by operation of the second air bag 42, so that the first air bag 41 encompasses the user's foot exactly to satisfy the ergonomics design. Further, the first air bag 41 is inflated or deflated to fit the foot sizes of different users, thereby enhancing the versatility of the airbag device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shoe structure comprising:

a shoe body (11*a*); and an elastic module (40) mounted on the shoe body;

wherein:

the shoe body includes a vamp (10), a sole (20) and an insole (30);

the vamp is provided with a wearing space (11);

the sole is provided with a receiving dimple (21) and a chamber (22);

the insole is mounted in the receiving dimple of the sole;

the sole has a periphery provided with a first valve hole (23) connected to the chamber and a second valve hole (24) connected to the chamber;

the first valve hole has a first channel (231);

the second valve hole has a second channel (241);

the elastic module is mounted in the wearing space of the vamp and includes a first air bag (41), a second air bag (42), a first control valve (43) and a second control valve (44);

the first air bag is combined with an inner periphery of the vamp;

the second air bag is mounted in the chamber of the sole;

the first control valve is connected with the second air bag and includes a first oneway air inlet (431), a first oneway air outlet (432), a first oneway valve seat (433) and a first regulating lever (434);

the first regulating lever is pivotally mounted in the first valve hole of the sole and is connected with the first oneway valve seat to control air inlet and outlet operation of the first control valve;

the second control valve is connected between the first air bag and the second air bag and includes a second oneway air inlet (441), a second oneway air outlet (442), a second oneway valve seat (443) and a second regulating lever (444); and the second regulating lever is pivotally mounted in the second valve hole of the sole and is connected with the second oneway valve seat to control air inlet and outlet operation of the second control valve.

2. The shoe structure of claim 1, wherein:

the first air bag of the elastic module is provided with an air nozzle (413) connected to the second control valve;

the first oneway valve seat of the first control valve includes two first connecting pipes (4331 and 4331*a*) respectively connected with the first oneway air inlet and the first oneway air outlet, and a first mounting tube (4332) connected between the two first connecting pipes;

the first mounting tube is mounted in the first valve hole of the sole;

the second oneway valve seat of the second control valve includes two second connecting pipes (4431 and 4431*a*) respectively connected with the second oneway air inlet and the second oneway air outlet, a second mounting tube (4432) connected between the two second connecting pipes, and an air pipe (4433) connected between the second mounting tube and the air nozzle of the first air bag;

the second mounting tube is mounted in the second valve hole of the sole;

the first regulating lever of the first control valve is provided with a first connecting end (4341) pivotally mounted in the first mounting tube of the first oneway valve seat;

the first connecting end of the first regulating lever has a center provided with a first connecting channel (4342) connected to the ambient environment and has a periphery provided with a first connecting hole (4343) connected to the first connecting channel;

the second regulating lever of the second control valve is provided with a second connecting end (4441) pivotally mounted in the second mounting tube of the second oneway valve seat; and the second connecting end of the second regulating lever has a center provided with a second connecting channel (4442) disconnected from the ambient environment and has a periphery provided with two second connecting holes (4443 and 4443*a*) connected to the second connecting channel.

3. The shoe structure of claim 1, wherein a pressure gauge (14) is mounted on the vamp, and the first air bag of the elastic module is provided with an air hole (414) connected to the pressure gauge.

4. The shoe structure of claim 1, wherein:

the second air bag has a center provided with a compression elastomer (422); and the second air bag has a periphery provided with a first inlet pipe (424) connected with the first oneway air inlet of the first control valve, a first outlet pipe (424*a*) connected with the first oneway air outlet of the first control valve, a second inlet pipe (425) connected with the second oneway air inlet of the second control valve, and a second outlet pipe (425*a*) connected with the second oneway air outlet of the second control valve.

5. The shoe structure of claim 2, wherein the first air bag of the elastic module is provided with an instep cushion portion (411) and a heel cushion portion (412) respectively resting on a periphery of the wearing space.

6. The shoe structure of claim 1, wherein:

the first connecting end of the first regulating lever has an outer wall provided with a first O-ring (4344) sealed in the first mounting tube of the first oneway valve seat;

the second connecting end of the second regulating lever has an outer wall provided with a second O-ring (4444) sealed in the second mounting tube of the second oneway valve seat;

the first mounting tube of the first oneway valve seat has an inner wall provided with a plurality of first positioning points (4333);

the first connecting end of the first regulating lever is provided with a first positioning hole (4346) locked onto one of the first positioning points of the first mounting tube;

the second mounting tube of the second oneway valve seat has an inner wall provided with a plurality of second positioning points (4334); and the second connecting end of the second regulating lever is provided with a second positioning hole (4446) locked onto one of the second positioning points of the second mounting tube.

* * * * *